United States Patent [19]

Ciari

[11] Patent Number: 5,042,839

[45] Date of Patent: Aug. 27, 1991

[54] FOOTWEAR SCRAPING APPARATUS

[76] Inventor: James R. Ciari, 1055 E. 14th Ave., Broomfield, Colo. 80020

[21] Appl. No.: 499,560

[22] Filed: Mar. 26, 1990

Related U.S. Application Data

[63] Continuation of Ser. No. 319,733, Mar. 7, 1989, abandoned.

[51] Int. Cl.[5] ..... A63C 11/18

[52] U.S. Cl. ..... 280/813; 15/237

[58] Field of Search ..... 280/813, 811, 809, 164.1, 280/164.2; 15/237, 238, 239, 240; 296/62

[56] References Cited

U.S. PATENT DOCUMENTS

| | | | |
|---|---|---|---|
| 890,097 | 6/1980 | Roesken et al. | 15/237 |
| 1,212,572 | 6/1914 | Sheridan | 280/164.2 |
| 3,284,091 | 11/1966 | Spier | 280/813 |
| 3,740,072 | 6/1973 | Veith | 280/164.2 |
| 3,826,518 | 7/1974 | Hennig | 280/813 |
| 3,975,036 | 8/1976 | Glenn | 280/813 |
| 3,976,303 | 8/1976 | Lillibridge et al. | 280/813 |
| 3,976,304 | 8/1976 | Lillibridge et al. | 280/813 |
| 3,999,773 | 12/1976 | Shuttleworth | 280/813 |
| 4,718,138 | 11/1988 | Brown et al. | 280/813 |

*Primary Examiner*—Charles A. Marmor
*Assistant Examiner*—Richard Camby
*Attorney, Agent, or Firm*—Harold A. Burdick

[57] ABSTRACT

A selectively positionable scraping apparatus is disclosed for scraping matter from the sole of articles of footwear, for example ski boots or shoes. The apparatus is mountable, for example, on the upper surfaces of a ski adjacent to the ski boot binding toe piece and includes a mounting portion and a scraper connected with the mounting portion and movable with respect thereto between stored and operative positions. A spring biases the scraper toward the operative position abutting the binding toe piece and a retainer connected with the mounting portion is provided for releasably securing the scraper in the stored position.

13 Claims, 2 Drawing Sheets

FOOTWEAR SCRAPING APPARATUS

This application is a file wrapper continuation of application Ser. No. 07/319,733, filed Mar. 7, 1989, now abandoned.

FIELD OF THE INVENTION

This invention relates to apparatus for removal of matter from surfaces, and, more particularly, relates to apparatus utilized for removal of matter from ground engagable units such as shoes, boots and the like.

BACKGROUND OF THE INVENTION

Devices for removal of matter clinging to shoes and boots have been heretofore known and/or utilized in many diverse configurations and have also heretofore been mounted on, or utilized in conjunction with, other structures such as skis, vehicles and the like (see, for example, U.S. Pat. Nos. 3,975,036, 890,097, 1,212,572, 3,740,072, 3,999,773, 3,976,303, 3,976,304, 3,284,091, and 3,826,518). Some such devices as have been heretofore known and/or utilized have had a scraper portion which is movable between stored and operative positions (see, for example, U.S. Pat. Nos. 3,975,036, 890,097, 1,212,527 and 3,740,072).

In particular, devices for removal of matter from the soles of ski boots and shoes are known, for example the device shown in U.S. Pat. No. 3,975,036 which is mounted to the upper surface of a ski, is movable between a stored position and an operative position, and includes braces and a catch separately attached to the ski. The catch is utilized to engage a slotted member extending vertically from the scraper to maintain the scraper in the stored position and includes a tab extending from one end thereof depression of which releases the catch. The braces are provided to stop movement of the scraper at the operative position when the catch is released.

Such heretofore known devices have not, however, always proven to be easily installed and utilized, nor have such devices provided for minimum disruption of the structural integrity of the structure to which it is mounted, enhanced safety of a user of such structure, for example by minimizing exposure of projections and edges of the device while the structure is being utilized, and compact maintenance of such devices in a stored position. Thus, while devices for removal of matter from shoes and boots are known, further improvement in such devices could still be utilized.

SUMMARY OF THE INVENTION

This invention provides an apparatus for enabling removal of matter from a ground engagable unit such as articles of footwear which includes a mounting portion and a scraper portion connected with the mounting portion and movable with respect thereto between stored and operative positions. The mounting portion is mountable on the surface of a structure, for example the upper surface of a ski, and may be positioned thereat adjacent to a utility structure utilized in association with the ground engagable unit, for example a ski boot binding toe piece, so that the scraper portion is at least partly maintained when in the operative position by the utility structure thus eliminating the need for attachment of additional structural elements, such as braces or the like, at the surface.

A retainer movably connected with the mounting portion is provided for releasable securement of the scraper portion when moved to the stored position and includes a latch for engagement in an aperture in the scraper portion, an upper part of the latch extending above the upper surface of the scraper portion when in the stored position so that the scraper portion is readily releasable by manipulation of the upper part of the latch. A biasing assembly biases the scraper portion toward the operative position and the latch toward an engaged position.

The mounting portion, scraper portion and retainer are configured to provide a compact and substantially projection free overall profile of the apparatus when the scraping portion is moved to the stored position.

It is therefore an object of this invention to provide an improved apparatus for enabling removal of matter from ground engagable units.

It is another object of this invention to provide an improved variably positionable footwear scraper.

It is still another object of this invention to provide a variably positionable footwear scraping apparatus attachable at the surface of a ski adjacent to a footwear binding piece positioned on the surface thus enabling utilization of existing structure to at least in part maintain operative positioning of a scraping portion of the apparatus.

It is yet another object of this invention to provide an apparatus for enabling removal of matter from a ground engagable unit having a retainer for releasably engaging at least a part of the upper surface of a variably positionable scraper portion.

It is another object to provide a scraping apparatus mountable to the upper surface of a ski which includes a mounting portion, a scraping portion connected with the mounting portion and movable between stored and operative positions with respect thereto, and a retaining portion for releasable securement of the scraper portion when in the stored position, the retainer portion including one part releasably engagable in an aperture in the scraper portion.

It is still another object of this invention to provide a variably positionable footwear scraper having a scraping portion positionable in stored and operative positions, the scraping portion being maintained in the stored position by a retainer having an upper part releasably engagable at an upper surface of the scraper portion when in the stored position so that the scraper portion is readily releasable by manipulation of the upper part of the retainer.

It is yet another object of this invention to provide a variably positionable footwear scraper having a mounting portion, a scraper portion, and a retainer for releasable securement of the scraper portion in a stored position, and which is configured to provide a compact and substantially projection free overall profile of the apparatus when the scraping portion is moved to a stored position.

It is still another object of this invention to provide an apparatus for enabling removal of matter from a ground engagable unit which includes a mounting portion having a scraper portion connected therewith and movable with respect thereto between stored and operative positions, and a retainer for releasable securement of the scraper portion when moved to the stored position, the scraper portion being biased toward the operative position.

With these and other objects in view, which will become apparent to one skilled in the art as the description proceeds, this invention resides in the novel construction, combination and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
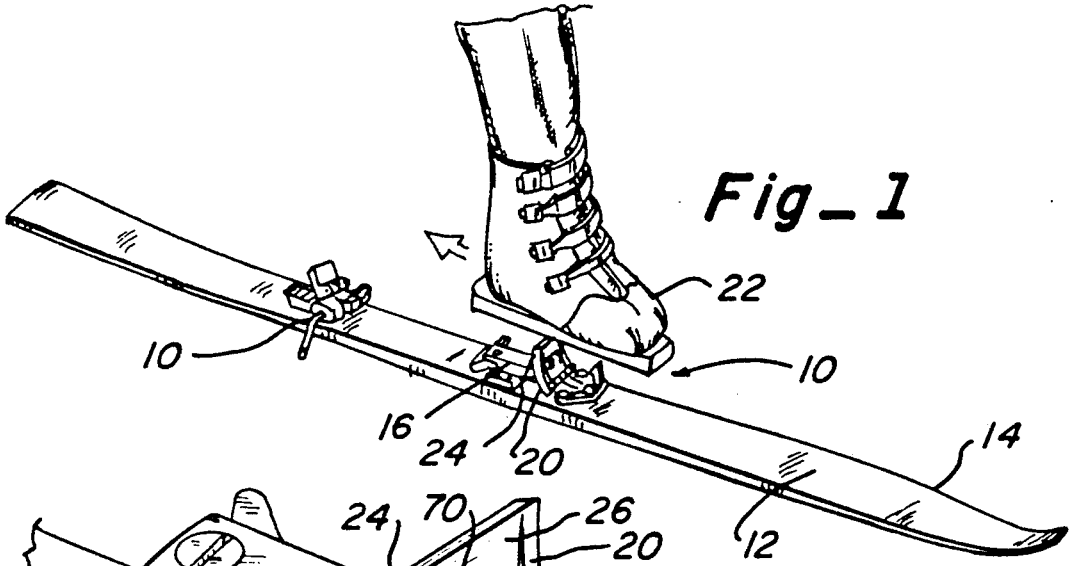
FIG. 1 is a perspective view illustrating the apparatus of this invention mounted to a ski and utilized for removal of undesired matter from a boot.

Variably positionable scraping apparatus 10 is shown in FIG. 1, for purposes of illustration, mounted on upper surface 12 of ski 14 adjacent to utility structure (for example a ski boot binding toe piece) 16 also mounted on surface 12 of ski 14. Ski 14, again for purposes of illustration, is provided with ski brakes 18, it being understood that other gear, for example cross country and mountaineering skis, could as well have apparatus 10 utilized in association therewith.

As illustrated in FIG. 1, apparatus 10 is in an operative position with the scraper portion 20 thereof abutting toe piece 16, in which position ground engagable unit (for example a boot) 22 is moved over scraping edge 24 for removal of undesired matter, such as ice, snow, mud, dirt and the like on the sole of boot 22.

Figure 2:
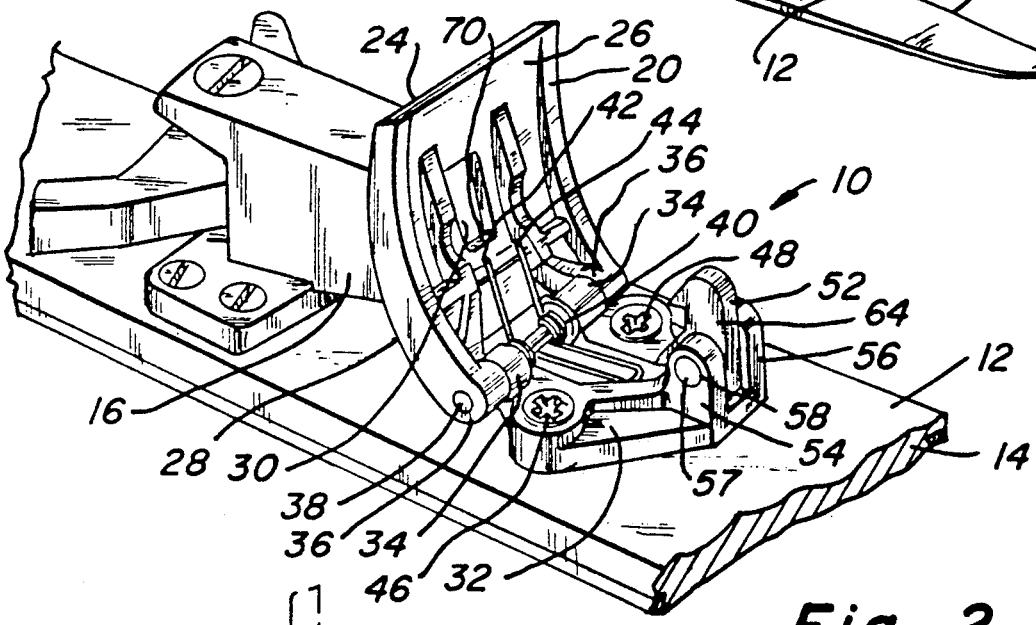
FIG. 2 is a perspective view of the apparatus as illustrated in FIG. 1 in an operative position.
Figure 3:
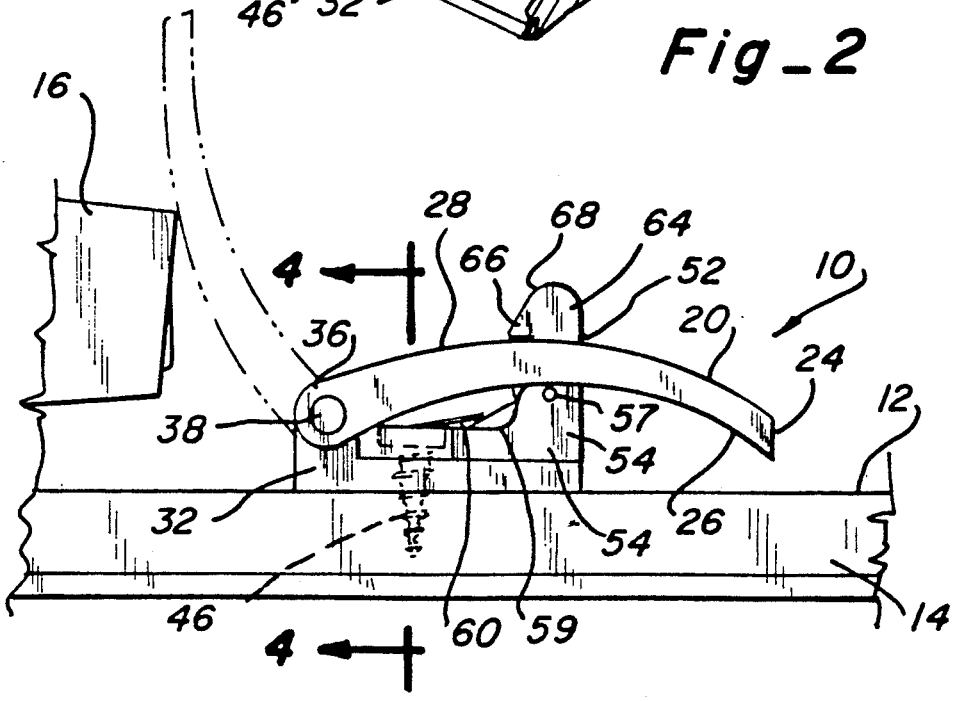
FIG. 3 is a side elevation view of the apparatus of FIG. 1 in a stored position.
Figure 4:
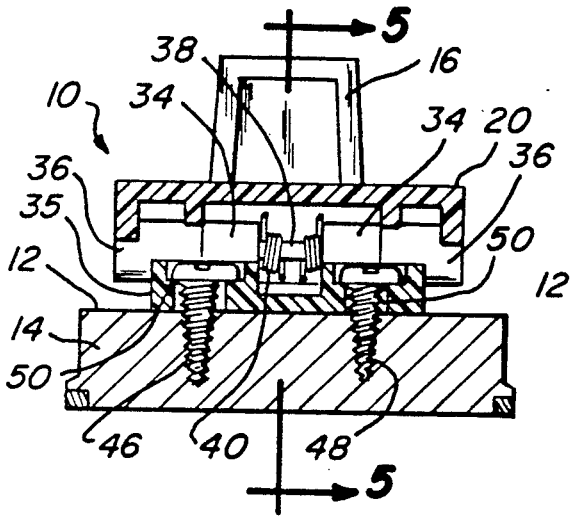
FIG. 4 is a sectional view of the apparatus taken along section lines 4—4 of FIG. 3.

As illustrated in FIGS. 2 through 6, apparatus 10 includes scraper portion 20 having scraping edge 24 thereat, scraping edge 24 having a surface forming an acute angle with the lower, arcuate surface 26 of scraper portion 20 so that when the scraper is in the operative position, as illustrated in FIGS. 1 and 2, matter is readily dislodgable. However, when scraper portion 20 is moved to the stored position, as shown in FIG. 3, the surface of scraper edge 24 defines an obtuse angle with surface 12 of ski 14 thereby enhancing user safety when apparatus 10 mounted to ski 12 is not being utilized.

Scraper 20 has upper arcuate surface 28 a portion of which abuts toe piece 16 when in the operative position to in part maintain scraper portion 20 in the operative position during utilization thereof, and includes a centrally positioned aperture 30 defined therethrough.

Scraper 20 is connected with mounting portion 32 including mounting blocks 34 extending from base plate 35. Blocks 34 have positioned adjacent thereto hinge members 36 of scraper portion 20, mounting block 34 and hinge members 36 being maintained in a hinge-like arrangement by connecting pin 38. Compression wound biasing spring 40 having bearing portions 42 and 44 bearing against scraper portion 20 is mounted inwardly of blocks 34 and around pin 38 for biasing scraper 20 toward the operative position abutting toe piece 16. Mounting screws 46 and 48 are provided for attaching mounting portion 32 adjacent to surface 12 of ski 14 through apertures 50 in base plate 35.

Retainer 52 is mounted adjacent to mounting blocks 54 and 56 of mounting portion 32 in a hinge-like arrangement, and is maintained thereat by connecting pin 57 through aperture 58 defined through the bottom portion of retainer 52 and mounting blocks 54 and 56. Retainer 52 includes recess 59 having hooked bearing portion 60 of biasing spring 40 positioned therein for biasing lower portion 61 downward toward base plate 35 thus biasing latch 64 rearward as retainer 52 pivots on pin 57.

Figure 5:
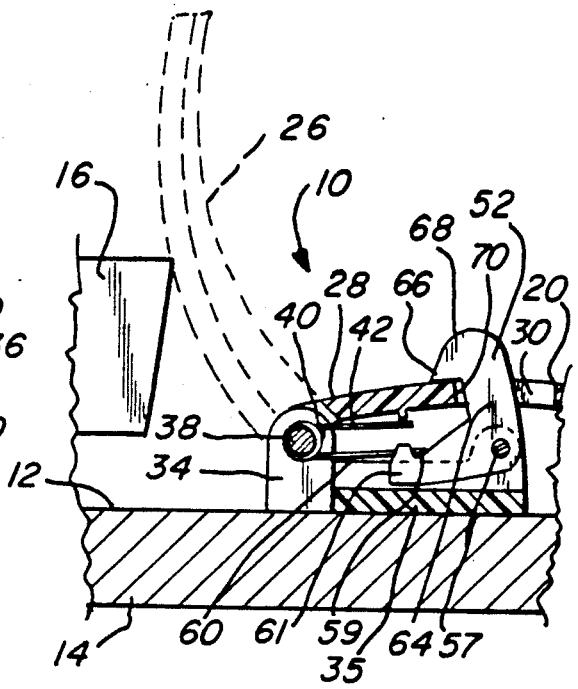
FIG. 5 is a sectional view of the apparatus taken along section lines 5—5 of FIG. 4.
Figure 6:
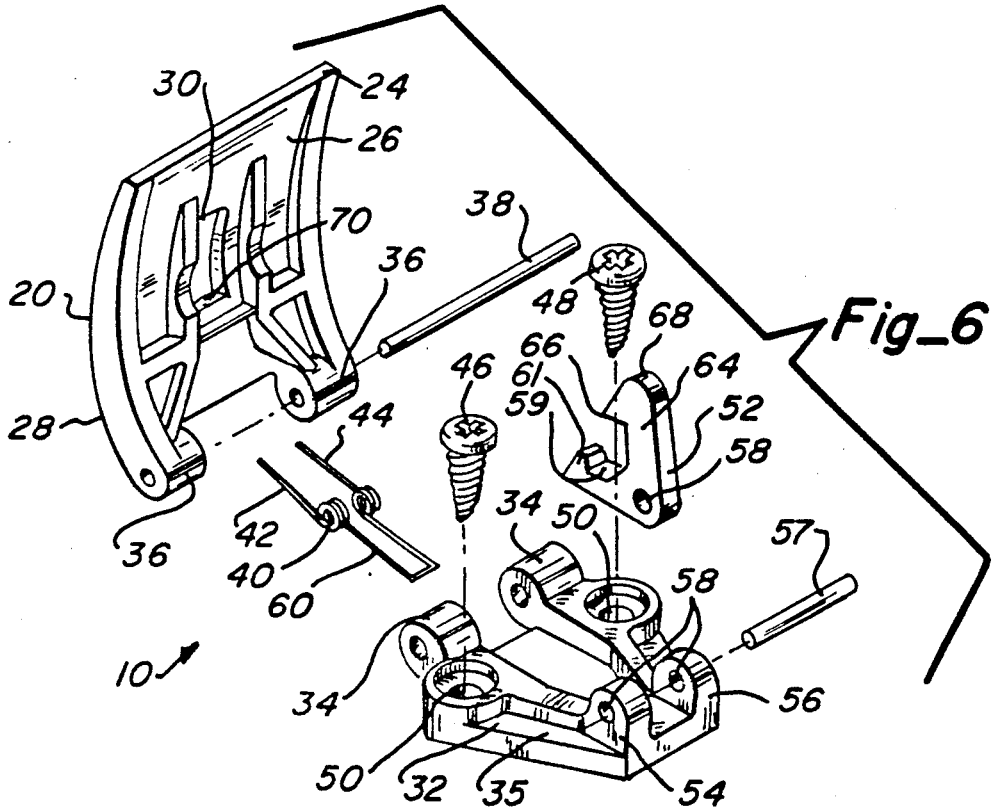
FIG. 6 is an exploded view of the apparatus illustrated in FIGS. 1 through 5.

As shown in FIGS. 3 and 5, latch 64 is thus biased toward a position engaging upper surface 28 of scraper 20 through aperture 30 therein for releasably securing scraper 20 when moved to the stored position. Latch 64 includes tongue 66 at an upper part thereof extending above upper surface 28 of scraper 20 when in a stored position. Arcuate upper section 68 extends from tongue 66 and is provided for enabling movement of latch 64 toward the front of ski 14 and against the force induced by spring 40 when lower surface 26 of scraper 20 adjacent rearward wall 70 of aperture 30 induces such movement by contact therewith thus allowing tongue 66 and upper section 68 to move through aperture 30 when scraper portion 20 is being moved toward the stored position by a user of the apparatus for securement thereof.

A user of the apparatus may release scraper portion 20 from securement by latch 64 for example by engagement of boot 22 with upper arcuate section 68 and forward movement thereof toward the tip of ski 14 until tongue 66 of latch 64 is released through aperture 30, whereupon scraper portion 20 is biased toward the operative position abutting toe piece 16 by spring 40.

When a user has completed scraping or cleaning a boot or shoe on scraper 20, movement of the scraper portion may be accomplished by manipulation thereof, for example utilizing the shoe or boot, until latch 64 is again engaged through aperture 30. It is of course possible to manipulate scraper portion 20 and latch 64 by other means, for example manually or by use of a ski pole or the like, but it has been found to be most desirable to provide an apparatus which is readily maneuverable without stooping or the like (resulting in potential loss of balance) to activate the apparatus.

As may be appreciated, mounting blocks 34, 54 and 56 and base plate 35 are unitarily formed, as are scraper portion 20, including hinge members 36, and retainer 52, and may be formed, for example, of lightweight, durable plastics, for example known polycarbonate plastic materials.

When thus configured, a variably positionable footwear scraper is provided which is easily installed and activated, and which is compact and substantially projection free when in the stored position thus enhancing user safety when the apparatus is positioned on a ski and not in use. A minimum number of attachment points to the ski are required thereby enabling maximization of maintenance of structural integrity of the ski. Since the binding toe piece already positioned on the ski is utilized, in conjunction with biasing spring 40, to maintain scraper 20 in the operative position with upper surface 28 thereof abutting the toe piece, provision of additional structure, such as braces and the like, to thus maintain the scraper, is unnecessary.

What is claimed is:

1. An apparatus for enabling removal of matter from a ground engagable unit, said apparatus being attachable adjacent to a surface having a related utility structure utilized in associated with said ground engagable unit thereat, said apparatus comprising:

mounting means for mounting said apparatus adjacent to said surface, said mounting means including a base unit having a forward section adjacent to said utility structure and a rearward section;

a scraper portion pivotably connected with said base unit of said mounting means so that said scraper portion is movable between stored and operative positions, said scraper portion being at least partly maintained at said operative position by said utility structure related to said surface, said scraper portion including a forward section adjacent to said utility structure and a rearward section;

connecting means for pivotably connecting said forward sections of said scraper portion and said base unit of said mounting means so that said scraper portion is maintained over said mounting means when in said store position; and releasable securing means pivotably connected with said base unit of said mounting means for releasably securing said scraper portion in said stored position.

2. The apparatus of claim 1 further comprising biasing means for biasing said securing means toward on engaged position adjacent to a part of said scraper portion when said scraper portion is in said stored position.

3. The apparatus of claim 2 wherein said scraper portion is biased toward said operative position abutting said utility structure by said biasing means when not secured by said releasable securing means.

4. The apparatus of claim 1 wherein at least parts of said mounting means and said scraper portion are made of lightweight, durable plastic material.

5. A variably positionable footwear scraper attachable to structure comprising:

a one-piece mounting portion mountable adjacent to said structure;

a scraper portion pivotably connected with said mounting portion by a connector so that said scraper portion is movable between stored and operative positions, said scraper portion having upper and lower surfaces, said lower surface facing said mounting portion when said scraper portion is in said stored position;

releasable securing means pivotably connected with said mounting portion for releasably engaging at least a part of said upper surface of said scraper portion thus securing said scraper portion when in said stored position; and biasing means adjacent to said connector for biasing said scraper portion toward said operative position and for biasing said releasable securing means toward engagement with said part of said upper surface of said scraper portion when said scraper portion is moved to said stored position.

6. The apparatus of claim 5 wherein said scraper portion has an aperture therein for engaging said releasable securing means when said scraper portion is in said stored position.

7. The apparatus of claim 6 wherein said releasable securing means includes an upper part positionable above said upper surface of said scraper portion when said scraper portion is in said stored position so that said scraper portion is releasable by manipulation of said upper part of said releasable securing means by a user engaging said footwear with said upper part of said releasable securing means.

8. The apparatus of claim 5 wherein said biasing means is a spring mountable over said connector and having first and second bearing portions, said first bearing portion bearing against said lower surface of said scraper portion and said second bearing portion bearing against a part of said releasable securing means.

9. A variably positionable footwear scraping apparatus attachable to a ski adjacent to a footwear binding piece attached to an upper surface of said ski, said apparatus comprising:

a one-piece mounting portion for mounting said apparatus adjacent to said upper surface of said ski;

a scraper portion having an aperture therein;

connecting means for connecting said scraper portion with said mounting portion so that said scraper portion is movable between stored and operative positions and having a biasing spring mounted therewith including a first portion and a second portion, said first portion of said biasing spring for biasing said scraper portion toward said operative position abutting said footwear binding piece; and releasable securing means connected with said mounting portion for releasably securing said scraper portion in said stored position and having one part thereof releasably engagable with said aperture in said scraper portion and a second part thereof for contacting said second portion of said biasing spring to bias said one part of said releasable securing means toward releasable engagement with said scraper portion through said aperture when said scraper portion is moved to said stored position.

10. The apparatus of claim 9 wherein said scraper portion has an upper surface, said upper surface abutting said footwear binding piece when said scraper portion is in said operable position, and wherein said one part of said releasable securing means has an upper section extending above said upper surface of said scraper portion when said scraper portion is in said stored position, said apparatus further comprising second connecting means for pivotably connecting said releasable securing means with said mounting portion at a position between said one part and said second part thereof.

11. The apparatus of claim 9 wherein said scraper portion and said mounting portion include forward sections adjacent to said footwear binding piece and rearward sections, and wherein said mounting portion and said scraper portion are connected by said connecting means at said forward sections thereof so that said rearward sections of said scraper portion nd said mounting portion are adjacent to each other when said scraper portion is in said stored position.

12. The apparatus of claim 9 wherein at least parts of said mounting portion, said scraper portion and said releasable securing means are made of lightweight, durable plastic material.

13. The apparatus of claim 9 wherein said scraper portion includes a scraping edge section, an upper surface abutting said footwear binding piece when said scraper portion is in said operative position and a lower surface, said scraping edge forming an acute angle with said lower surface of said scraper portion so that material is readily dislodgable when said scraper portion is in said operative position, and so that when said scraper is in said stored position said scraping edge is adjacent to said upper surface of said ski and defines an obtuse angle therewith to thereby provide enhanced safety to a user of said ski having said apparatus attached thereto.

* * * * *